US006244501B1

(12) United States Patent
Choi

(10) Patent No.: US 6,244,501 B1
(45) Date of Patent: Jun. 12, 2001

(54) MULTI-PURPOSE PACKAGE ASSEMBLY

(76) Inventor: Deokwhan Choi, Keonyoung Apt. 102-1705, 108, Chungdam dong, Kangnam-gu, Seoul (KR)

( * ) Notice: Subject to any disclaimer, the term of this patent is extended or adjusted under 35 U.S.C. 154(b) by 0 days.

(21) Appl. No.: 09/366,835

(22) Filed: Aug. 4, 1999

(30) Foreign Application Priority Data

Apr. 29, 1999 (KR) ..... 99-15480
May 20, 1999 (KR) ..... 99-18258

(51) Int. Cl.[7] ..... B65D 5/48

(52) U.S. Cl. ..... 229/120.01; 220/23.2; 229/116.1; 229/120.03; 229/120.09; 229/162

(58) Field of Search ..... 229/108, 116.1, 229/120.01, 120.03, 120.09, 162, 120.011; 220/23.2, 23.4, 23.8; 206/766; D9/346

(56) References Cited

U.S. PATENT DOCUMENTS 1,095,671 * 5/1914 Pitkin ..... 229/120.01
1,998,147 * 4/1935 Stegman ..... 229/120.011
2,726,004 * 12/1955 McLeod ..... 220/23.4
3,058,644 * 10/1962 Zastrow ..... 229/120.01
3,357,543 * 12/1967 Taggart ..... 229/162
3,397,771 * 8/1968 Fogle ..... 229/120.09
3,404,818 * 10/1968 Miscoe ..... 220/23.4
3,880,342 * 4/1975 Longo, Jr. ..... 229/120.03
4,231,509 * 11/1980 Austin ..... 229/162
4,256,223 * 3/1981 Pawlowski ..... 229/162
4,320,846 * 3/1982 Meyering et al. ..... 220/23.8
4,382,344 * 5/1983 Freeman ..... 229/120.01
4,856,706 * 8/1989 Van Der Straten ..... 229/120.18
4,919,293 * 4/1990 Buckley ..... 220/23.2

* cited by examiner

*Primary Examiner*—Gary E. Elkins
(74) *Attorney, Agent, or Firm*—Baker Botts L.L.P.

(57) ABSTRACT

A multi-purpose package assembly includes a plurality of containers each having an inner space for receiving a variety of things, a connecting member for connecting each of the neighboring containers such that the containers can be bi-directionally bent toward each other, and a display member formed at each of the containers to display the things placed on the inner space of the container such that the things can be partially exposed to external viewers. The container is produced at a developed state such that the developed product can be folded up for storing purpose and also unfolded to be made into a box shape to function as the container.

23 Claims, 13 Drawing Sheets

MULTI-PURPOSE PACKAGE ASSEMBLY

BACKGROUND OF THE INVENTION (a) Field of the Invention

The present invention relates to a multi-purpose package assembly and, more particularly, to a multi-purpose package assembly which can receive or pack a variety of things and display the things at various manners while giving the user great convenience in storage and assemblage.

(b) Description of the Related Art

Generally, package boxes for packing articles such as coffee or cosmetic products can be largely classified into a built-in type where all components are made into a body to be directly used and a padding type where all components are separately manufactured and assembled at use.

The built-in typed package boxes have an advantage in that they can be easily manufactured. But, they take up much space and make it difficult to store them in narrower places. Furthermore, where there are needs to display the articles contained in such boxes for sale, the user is obliged to bear inconvenience because the articles should pick up from the package boxes one by one.

In contrast, the padding typed package boxes have an advantage in that they can be folded up and stored in relatively narrow places. But, at each use, they should be carefully assembled one by one. Furthermore, for the displaying purpose, it turns out that the same problem as found in the built-in typed boxes is still present in the padding typed package boxes.

SUMMARY OF THE INVENTION

It is an object of the present invention to provide a multi-purpose package assembly which can receive or pack a variety of things and display the things at various manners.

It is another object of the present invention to provide a multi-purpose package assembly which can be conveniently stored even in an extremely narrow place and easily assembled at use.

These and other objects may be achieved by a multi-purpose package assembly including a plurality of containers each having an inner space for receiving a variety of things, a connecting member for connecting each of the neighboring containers such that the containers can be bi-directionally bent toward each other, and a display member formed at each of the containers to display the things placed on the inner space of the container such that the things can be partially exposed to external viewers. The container is produced at a developed state such that the developed product can be folded up for storing purpose and also unfolded to be made into a box shape to function as the container.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

FIGS. 1 to 5 are views illustrating a multi-purpose package assembly according to a first preferred embodiment of the present invention. As shown in the figures, the package assembly includes a plurality of containers 1 each having an inner empty space 2. In this preferred embodiment, the number of the containers 1 is three. The containers 1 are made in paper, wood, plastic, synthetic resin, glass, cloth, cotton flannel, metal, leather or other materials. Each of the containers 1 is produced with a developed state shown in FIG. 2 and, at that state, it can be folded up for storing purpose and also unfolded to be made into a box shape to function as the container 1.

The package assembly further includes a connecting member the connecting each of the neighboring containers 1 such that they can be bi-directionally bent toward each other, and a display member for displaying the content placed in the inner space 2 of the container 1 such that it can be partially exposed to external viewers.

The containers 1 are sequentially arranged one after another in a predetermined direction. The containers 1 are formed each with bottom and top parallelogram-shaped sides such that when the containers 1 are united into one body, the top and bottom sides of the united body may be formed each with a hexagonal shape shown in FIG. 5. It is possible that the top and bottom sides of the container 1 might be formed with a shape of an octagon or other polygons, or a curved figure.

Figure 2:
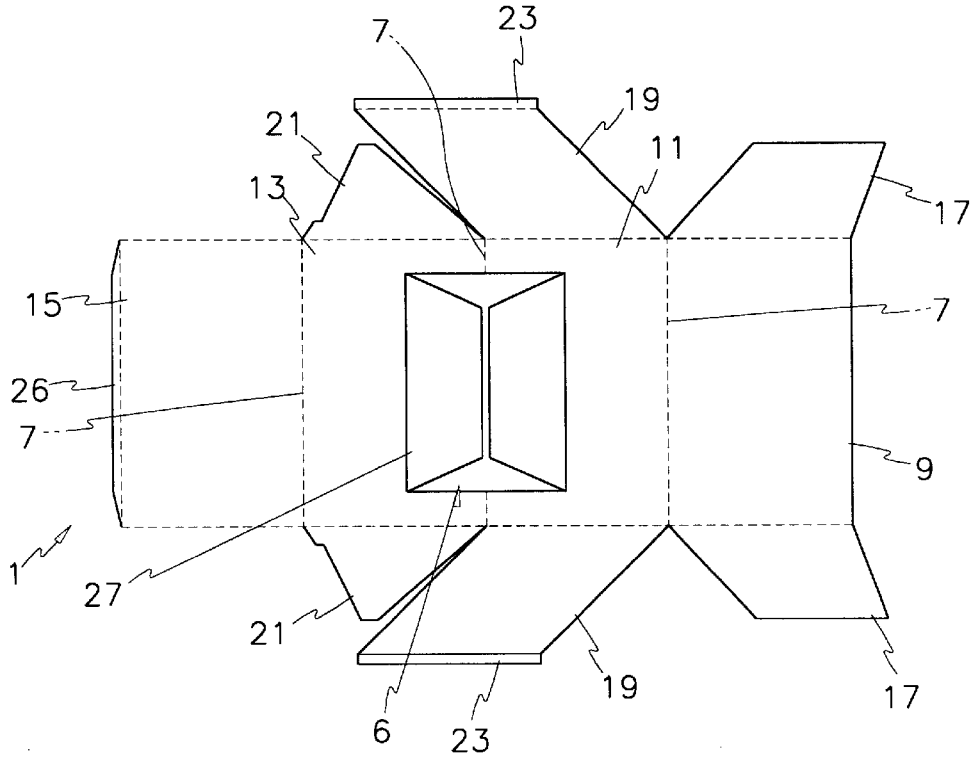
FIG. 2 is a developmental view of the container shown in FIG. 1.

As shown in FIG. 2, the container 1, at its developed state, is provided with rectangular-shaped body sub-portions 9, 11, 13 and 15. Creases 7 are formed at borderlines in-between the corresponding neighboring sides 9, 11, 13 and 15. Each of the body sub-portions 9, 11, 13 and 15 can be folded or unfolded along the corresponding crease 7. A plurality of top and bottom side sub-portions 17, 19 and 21 is extended from upper and lower ends of the corresponding body sub-portions 9, 11 and 13.

A first fitting member 23 is protruded from each of the top and bottom side sub-portions 19 such that it can be folded or unfolded. This is to make the top and bottom side sub-portions 17, 19 and 21 to be in a stuck state at proper places.

A rectangular-shaped opening portion 6 is formed over the center-sided body sub-portions 11 and 13 to function as the display member. The opening portion 6 is made by cutting an appropriate part of the body sub-portions 11 and 13 into several sections 27. It is possible that such opening portion may be formed at only one of the body sub-portions and have other shapes such as heart, circle, oval, polygon or star.

A transparent material such as glass or a semitransparent material may be provided at the body sub-portions of the containers 1 to function as the display member.

In order to display the content of the container 1 more clearly, a base 29 may be positioned on the bottom side of the container 1 to mount the content thereon.

Figure 1:
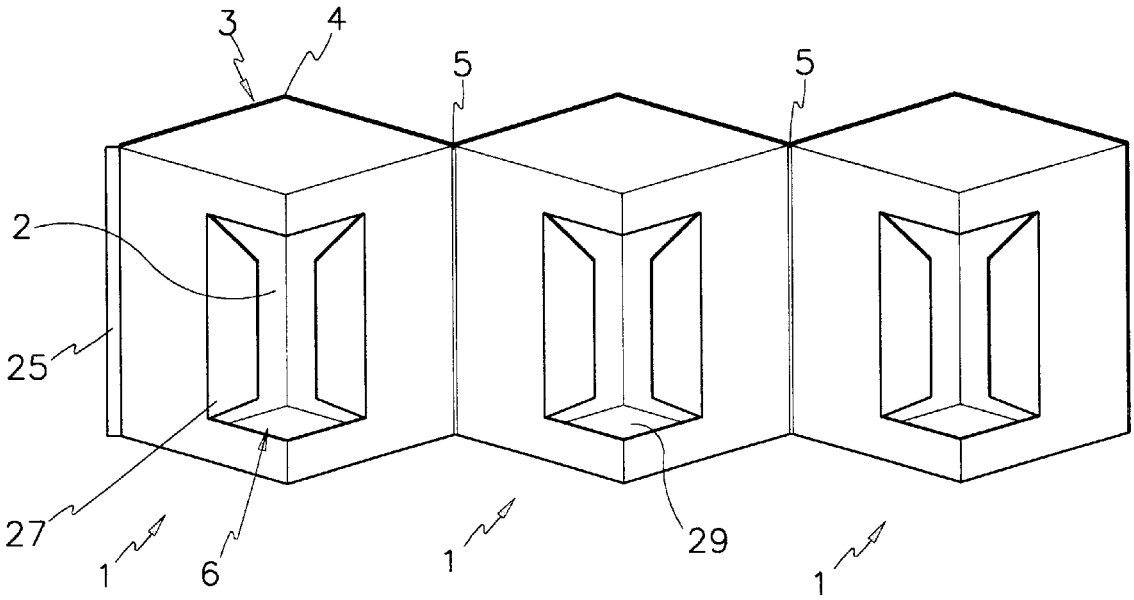
FIG. 1 is a perspective view of a multi-purpose package assembly with three containers according to a first preferred embodiment of the present invention.

When the container 1 is shifted from its developed state into a box-shaped state and assembled with other containers while positioning the opening portion 6 at the front side, a covering sheet 3, as shown in FIG. 1, is attached onto the back side of the containers 1 to function as the connecting member.

The covering sheet 3 has also creases 4 and 5 capable of being adapted to the creases 7 formed at the borderlines of the body sub-portions 9, 11, 13 and 15.

A second fitting member 25 is protruded from a lateral end of the covering sheet 3. When the containers 1 are united into one body externally covered by the covering sheet 3, the second fitting member 25 is fitted into the corresponding body sub-portion of the container 1 to keep the united containers 1 in a fixed state. Alternatively, instead of the second fitting member 25, a second fitting member 26 may be formed at the body sub-portion of the outermost container 1. Adhesives may be applied onto the second fitting member 25 or 26 to reinforce the fixed state.

Figure 4:
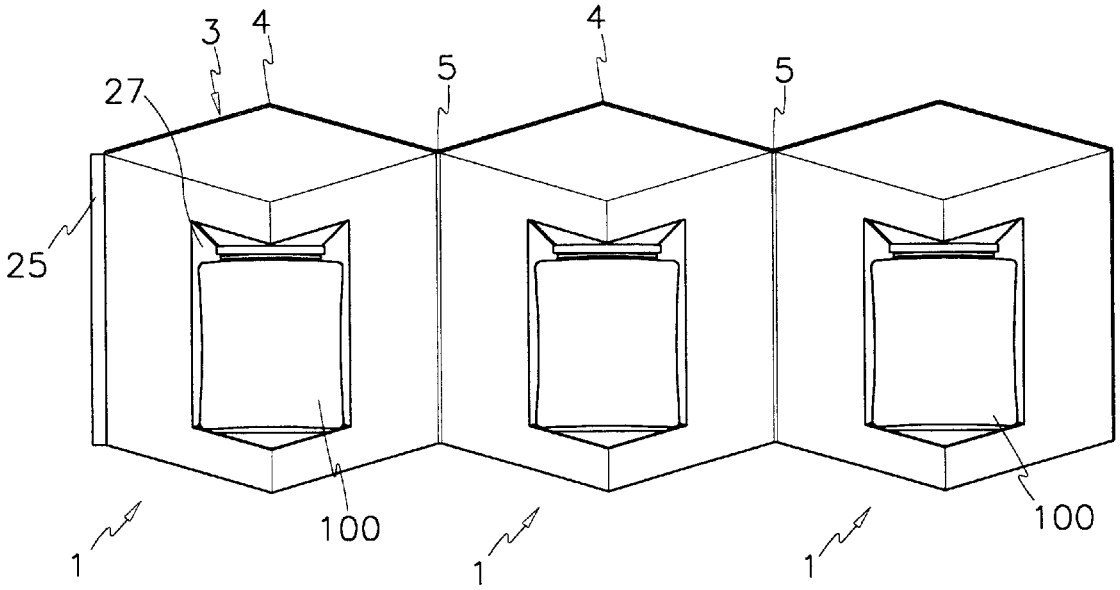
FIG. 4 is a perspective view of the multi-purpose package assembly shown in FIG. 1 illustrating a first usage example.

When the containers 1 are assembled with the covering sheet 3 to form a package assembly, as shown in FIG. 4, an article 100 is inserted into the inner space 2 of each container 1 through the opening portion 6 and positioned on the base 29.

At this state, the shape of the package assembly can be changed to display the article 100 in various ways. For instance, as shown in FIG. 4, the containers 1 may be arranged in a horizontal line such that the content 100 can be seen from the front side through the opening portion 6.

Figure 5:
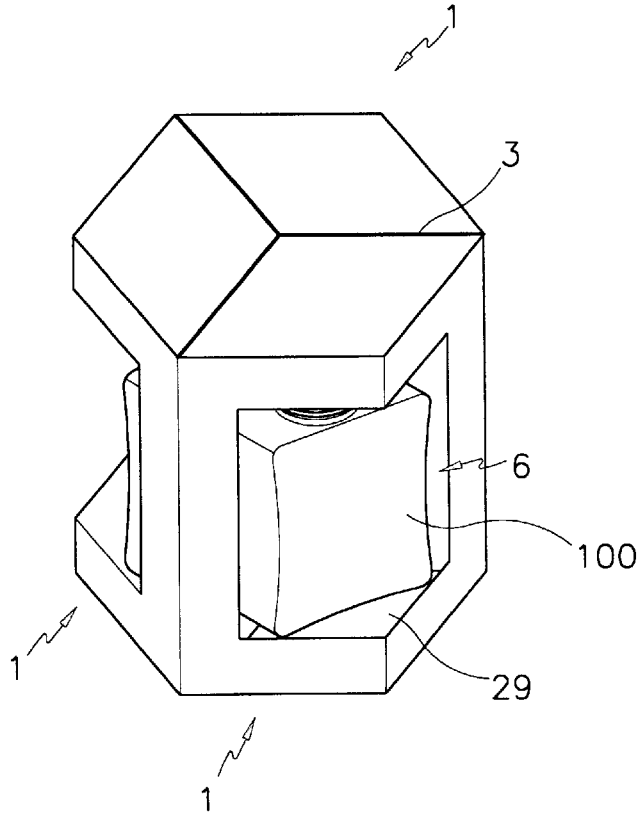
FIG. 5 is a perspective view of the multi-purpose package assembly shown in FIG. 1 illustrating a second usage example.

Furthermore, the containers 1 may be rolled and united into one body in the counter-clockwise direction on the basis of FIG. 4. In this case, as shown in FIG. 5, the article 100 can be seen from all directions through the opening portion 6.

Alternatively, the containers 1 may be rolled and united into one body in the clockwise direction on the basis of FIG. 4. In this case, the article 100 is intercepted from the outside via the non-opening body portions of the containers 1.

In addition, it is also possible to make only two of the containers 1 to contact each other while stretching one of the containers 1 at a predetermined angle.

A variety of things may be placed in the containers 1 as the content 100. For example, the content 100 may be articles of food, electronics, clothes and other various articles.

The package assembly may be used for various purposes. For example, it can be used as a chair such that the user can sit on the top side of the united containers. It may be used as a calendar such that twelve months can be indicated on the twelve body sub-portions of the containers shown in FIG. 1. It may be used as a furniture for reserving clothes or bedclothes. In this case, a door can be formed at the container 1. It may be used as a pencil receptacle or a savings box. In this case, openings or slots may be formed on the top portion of the package assembly.

Other preferred embodiments of the present invention will be described below. In the following embodiments, the main structure of the package assembly is the same as that of the first preferred embodiment except that additional components will be presented or some of the previously described components will be replaced by new ones. These changes will be all described based on the corresponding figures.

Figure 6:
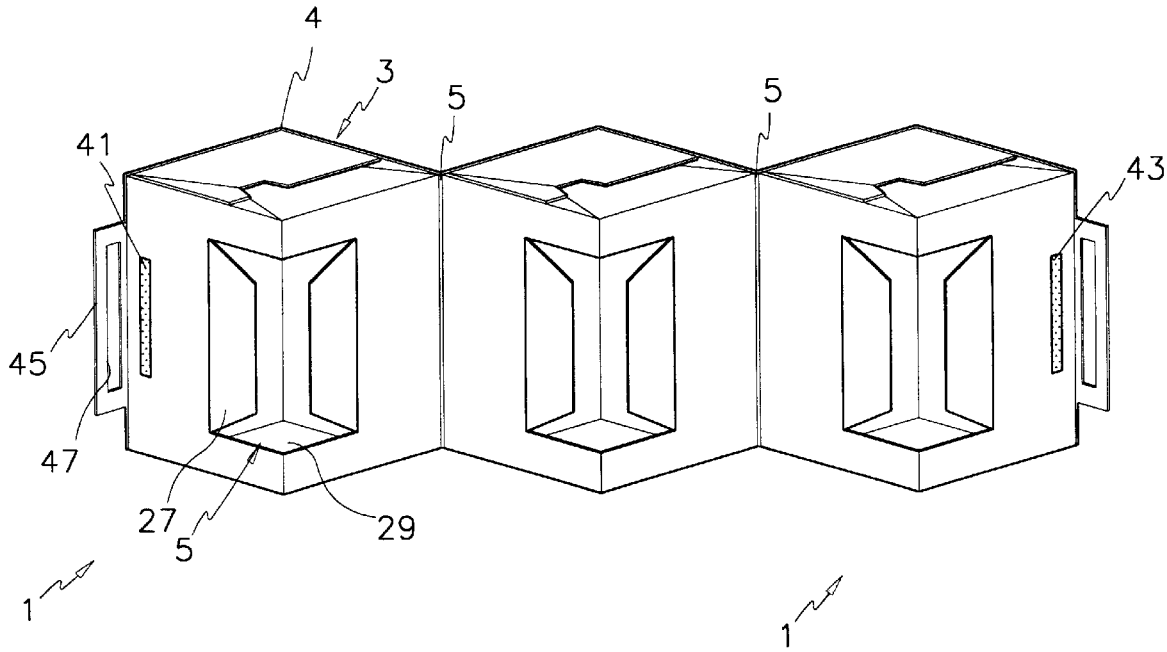
FIG. 6 is a perspective view of a multi-purpose package assembly with three containers according to a second preferred embodiment of the present invention.
Figure 3:
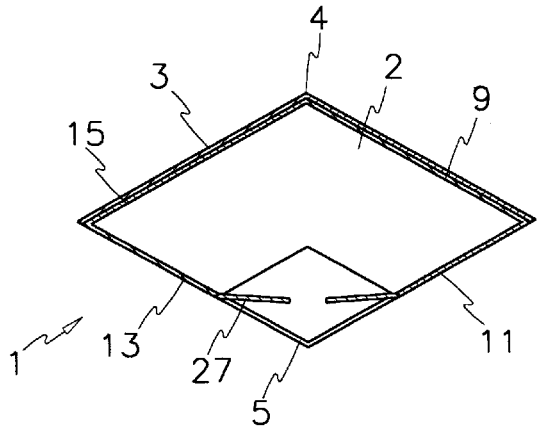
FIG. 3 is a partially sectional plan view of the multi-purpose package assembly shown in FIG. 1.
Figure 7:
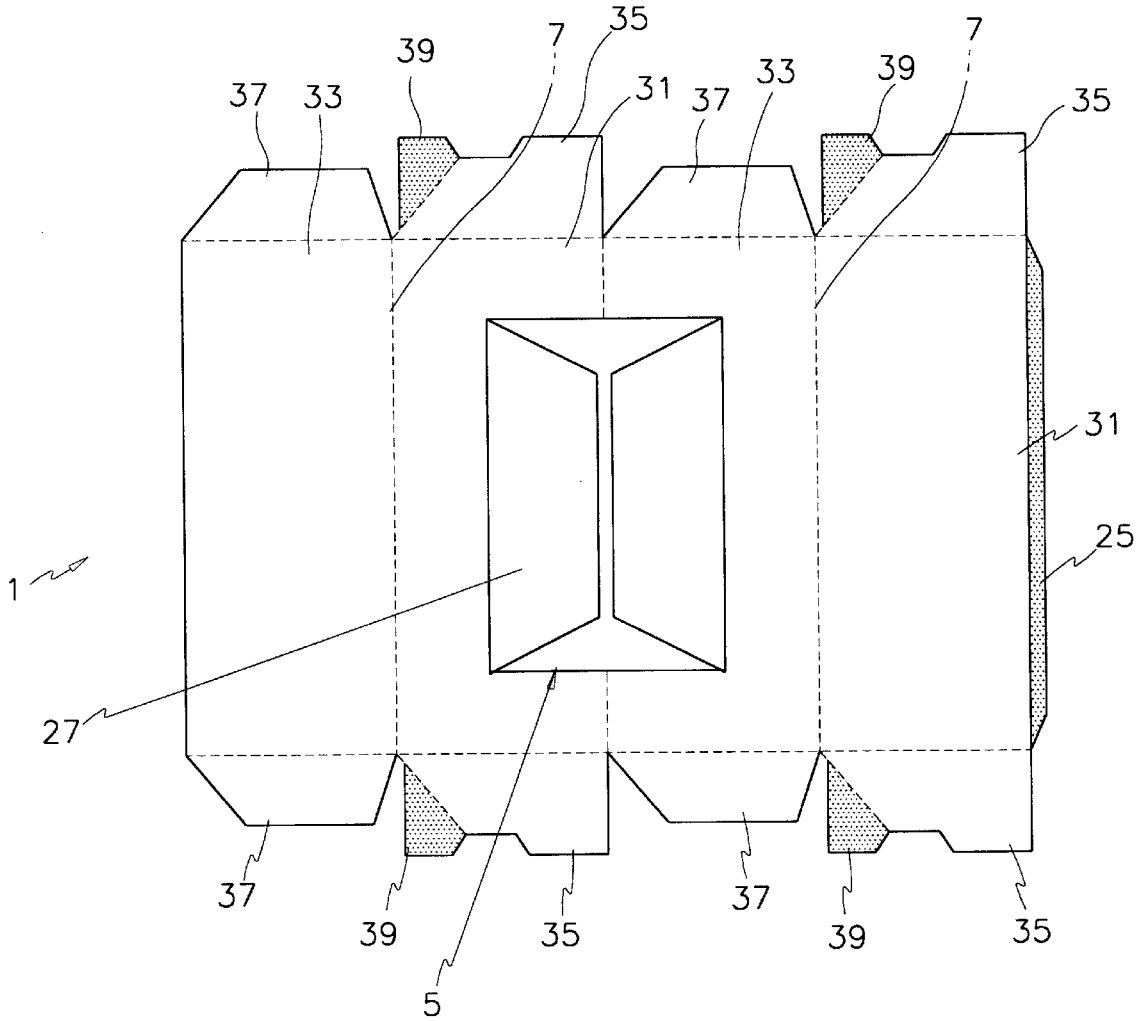
FIG. 7 is a developmental view of the container shown in FIG. 6.

FIGS. 6 and 7 are views of a package assembly according to a second preferred embodiment of the present invention. As shown in FIG. 7, where the container 1 is drawn in its developed state, the container 1 includes a pair of first and second rectangular-shaped body sub-portions 31 and 33. A pair of first and second top and bottom side sub-portions 35 and 37 is extended from upper and lower ends of the corresponding body sub-portions 31 and 33.

A first fitting member 39 is protruded from each of the top and bottom side sub-portion 35 such that it can be folded or unfolded. This is to make the top and bottom side sub-portions 35 and 37 to be in a stuck state at proper places.

A pair of second fitting members 41 and 43 is formed at the body sub-portions of the containers 1. When the containers 1 are united into one body externally covered by the covering sheet 3, the second fitting members 41 and 43 are combined with each other to keep the united containers 1 in a fixed state.

The second fitting members 41 and 43 may be formed with Velcro fasteners, buttons or zippers.

As shown in FIG. 6, a hand-gripping member is protruded from the body sub-portions of the containers 1 or the covering sheet 3. When the containers 1 are united into one body, the user can carry the united body at the hand-gripping member. The hand-gripping member includes extensions 45 protruded from the body sub-portions of the containers 1 or the covering sheet 3, and an opening portion 47 formed at the center area of each extension 45.

Figure 8:
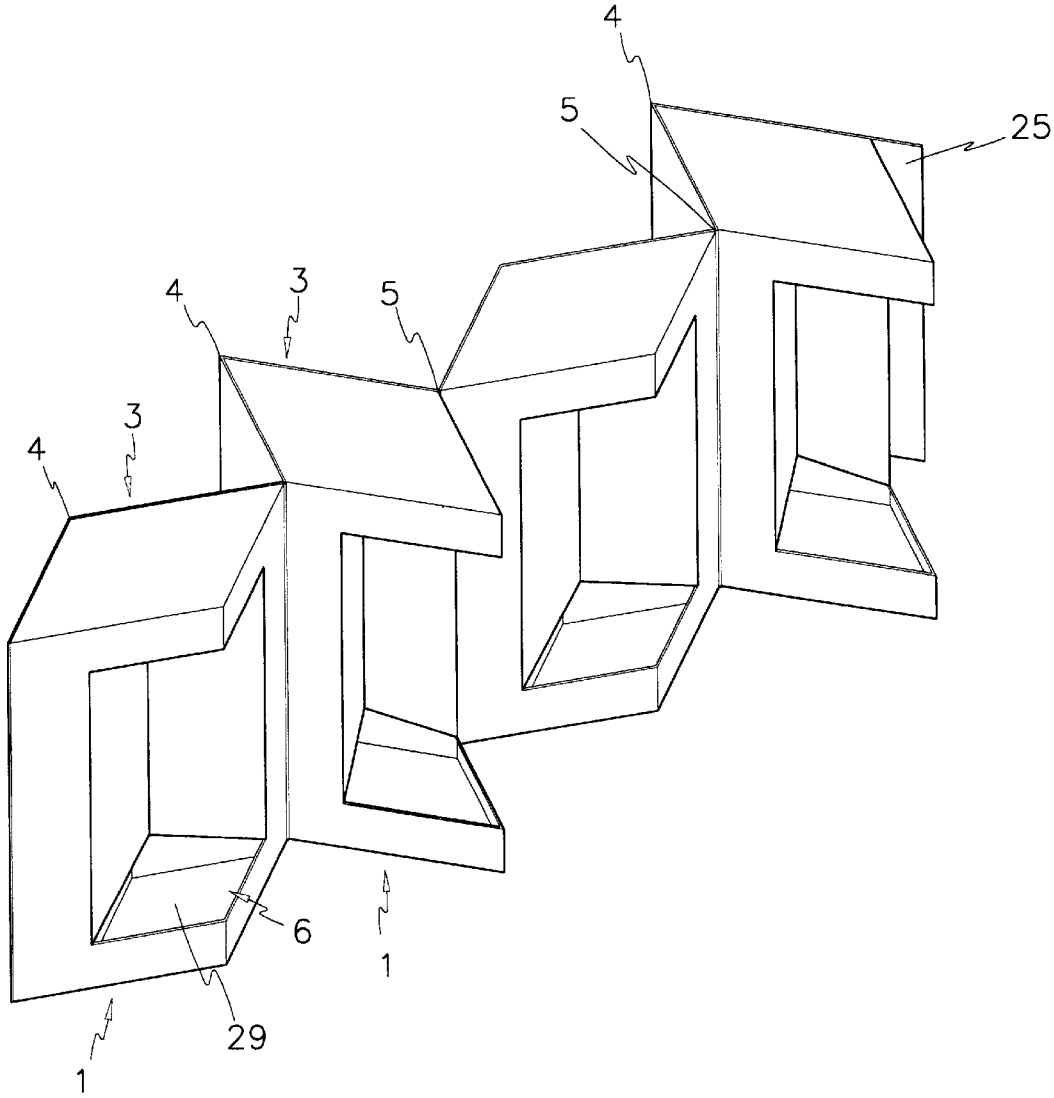
FIG. 8 is a perspective view of a multi-purpose package assembly according to a third preferred embodiment of the present invention.
Figure 9:
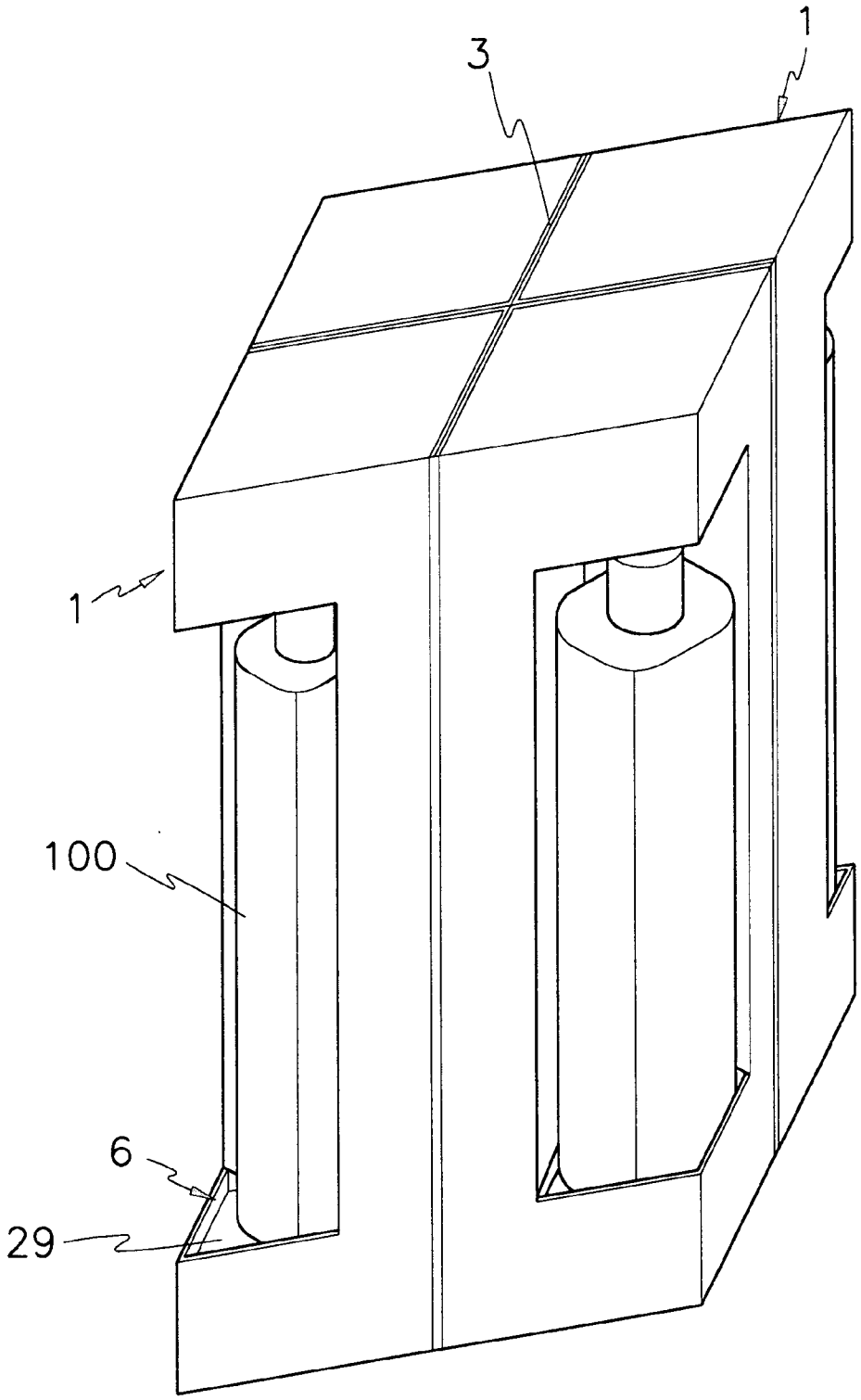
FIG. 9 is a perspective view of the multi-purpose package assembly shown in FIG. 8 illustrating a usage example.

FIGS. 8 and 9 are views of a package assembly according to a third preferred embodiment of the present invention. As shown in FIG. 8, in this preferred embodiment, the number of the containers 1 is four and the top and bottom sides of each container 1 are formed each with a rectangular shape. The containers 1 are arranged in a zig-zag manner. When the containers 1 are untied into one body externally covered by the covering sheet 3, the top and bottom sides of the united body each become to be formed with a rectangular shape.

Figure 10:
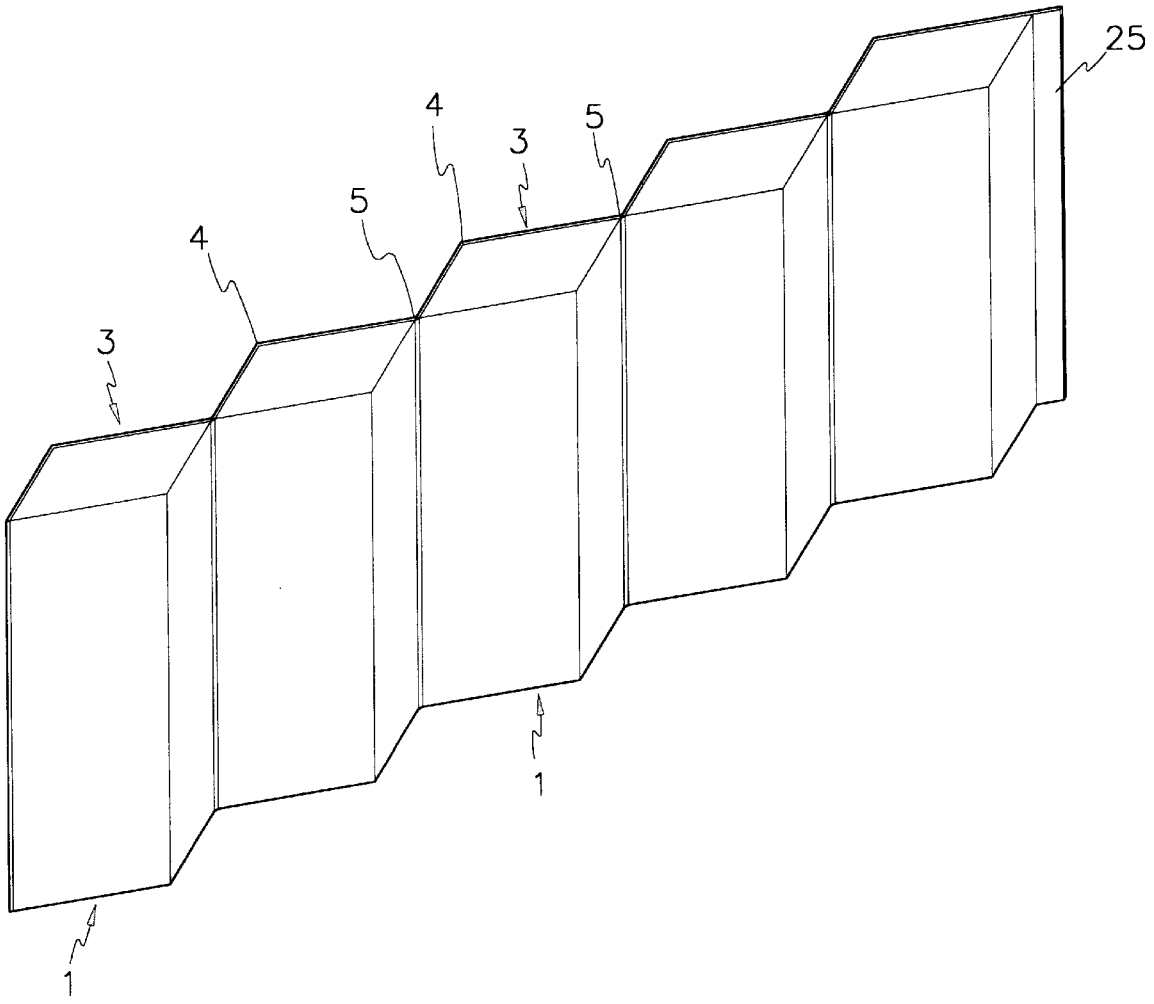
FIG. 10 is a perspective view of a multi-purpose package assembly according to a fourth preferred embodiment of the present invention.
Figure 11:
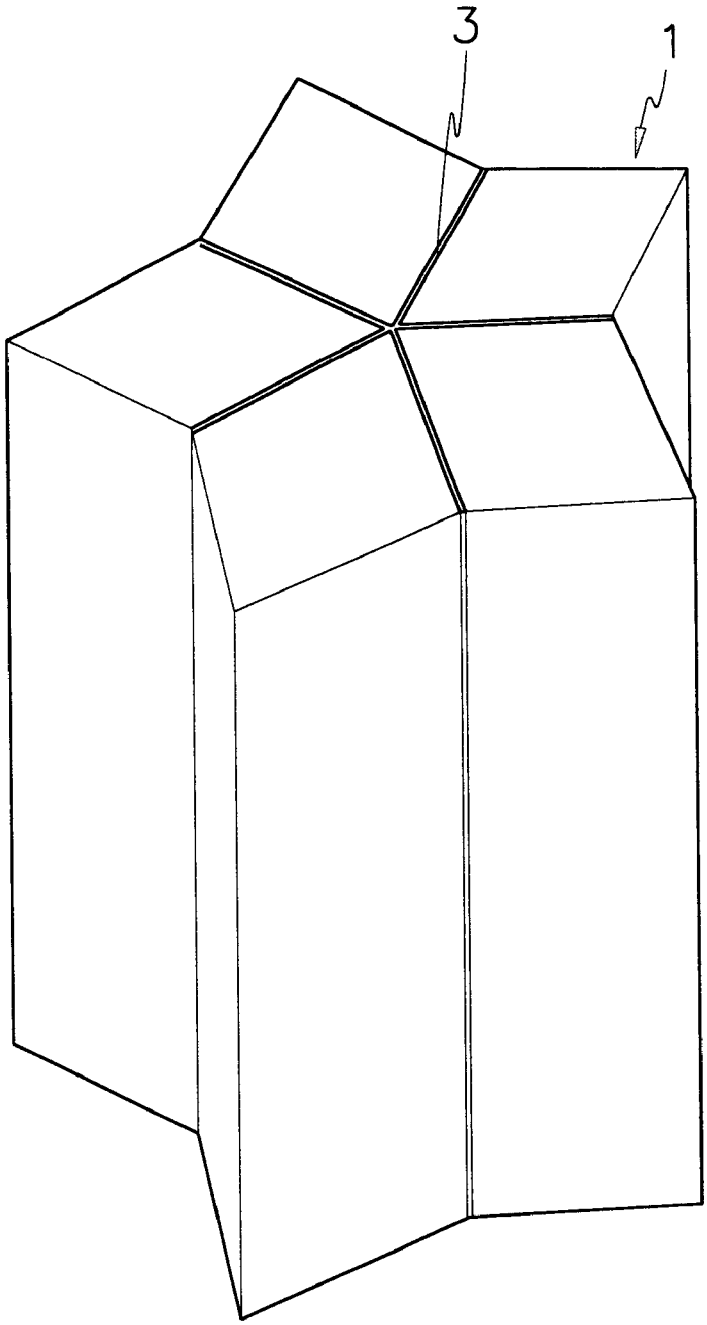
FIG. 11 is a perspective view of the multi-purpose package assembly shown in FIG. 10 illustrating a usage example.

FIGS. 10 and 11 are views of a package assembly according to a fourth preferred embodiment of the present invention. As shown in FIG. 10, in this preferred embodiment, the number of the containers 1 is five and the top and bottom sides of each container 1 are formed each with a parallelogram shape. When the containers 1 are united into one body internally covered by the covering sheet 3, as shown in FIG. 11, the top and bottom sides of the united body each become to be formed with a star shape.

Figure 12:
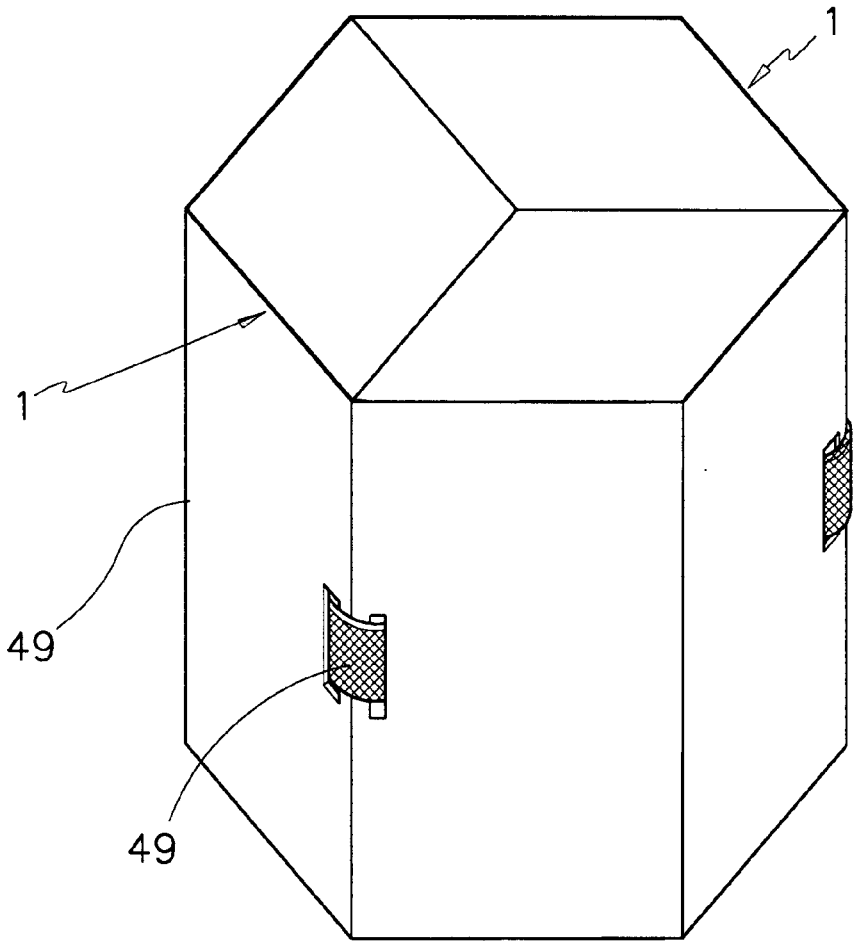
FIG. 12 is a perspective view of a multi-purpose package assembly according to a fifth preferred embodiment of the present invention.

FIG. 12 is a view of a package assembly according to a fifth preferred embodiment of the present invention. As shown in FIG. 12, in this preferred embodiment, a plurality of bands 49 is provided as the connecting member to bind each of the neighboring containers 1. Instead of the bands 49, a plurality of elastic members may be provided at the corresponding portions.

Of course, suitable numbers of band accommodating slits are formed at the body sub-portions of the containers 1.

Figure 13:
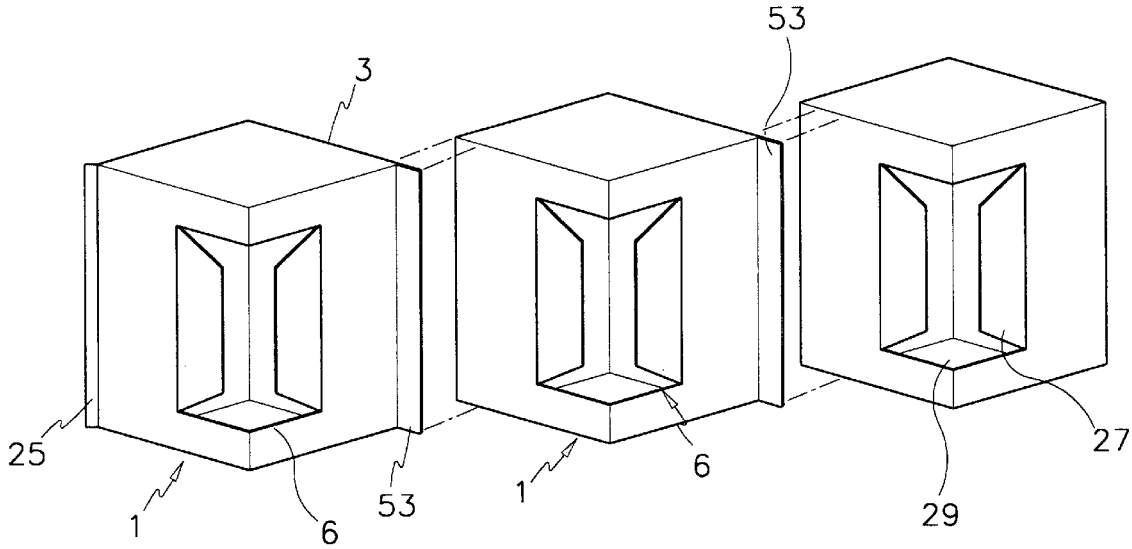
FIG. 13 is an exploded perspective view of a multi-purpose package assembly to a sixth preferred embodiment of the present invention.

FIG. 13 is a view of a package assembly according to a sixth preferred embodiment of the present invention. As shown in FIG. 13, suitable numbers of extensions 53 are protruded from the body sub-portions of the containers 1 to function as the connecting member. Each of the extension 53 is applied with adhesives and fitted into the body sub-portion of the neighboring container 1 such that the containers 1 can be properly folded or unfolded.

Alternatively, for use as the connecting member, the contacting edges of the neighboring containers 1 may be provided with suitable numbers of protrusions and grooves, respectively. When the containers 1 are assembled, the protrusions are inserted into the grooves and fixtures are interposed between them.

Figure 14:
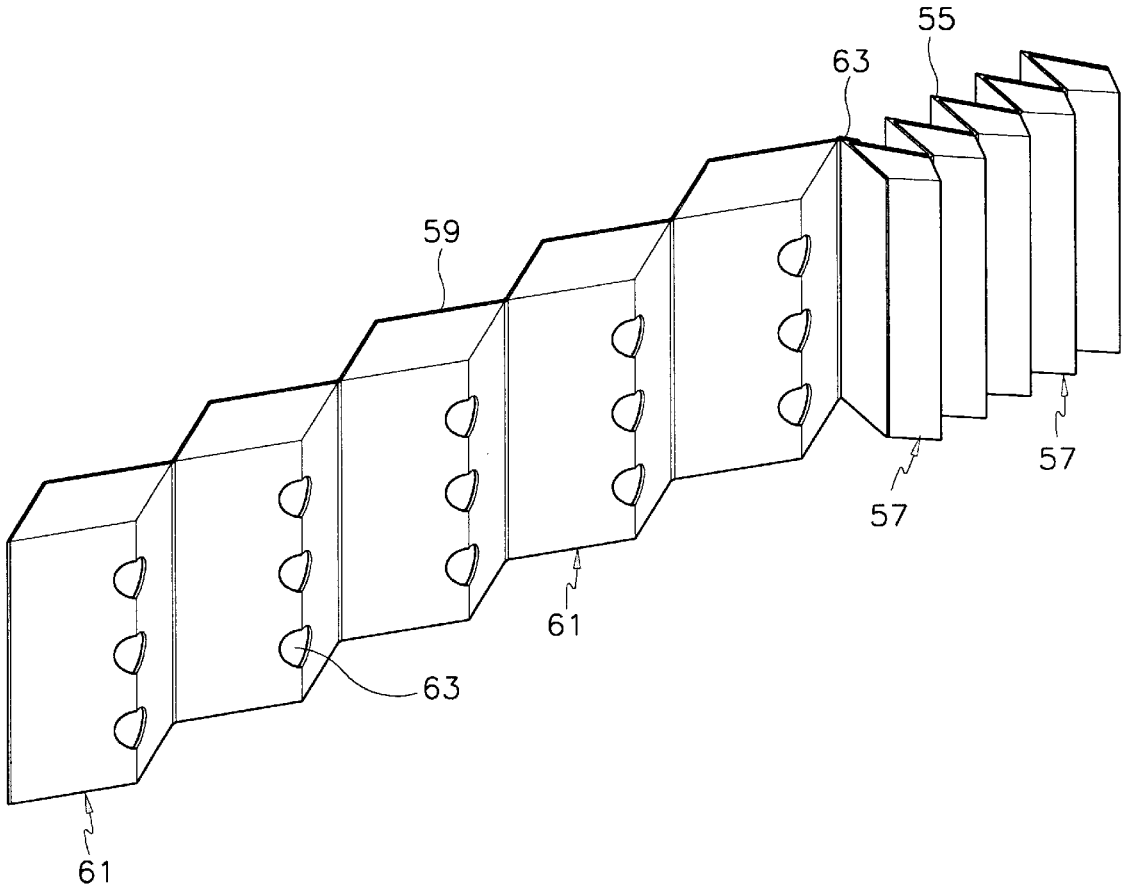
FIG. 14 is a perspective view of a multi-purpose package assembly to a seventh preferred embodiment of the present invention.
Figure 15:
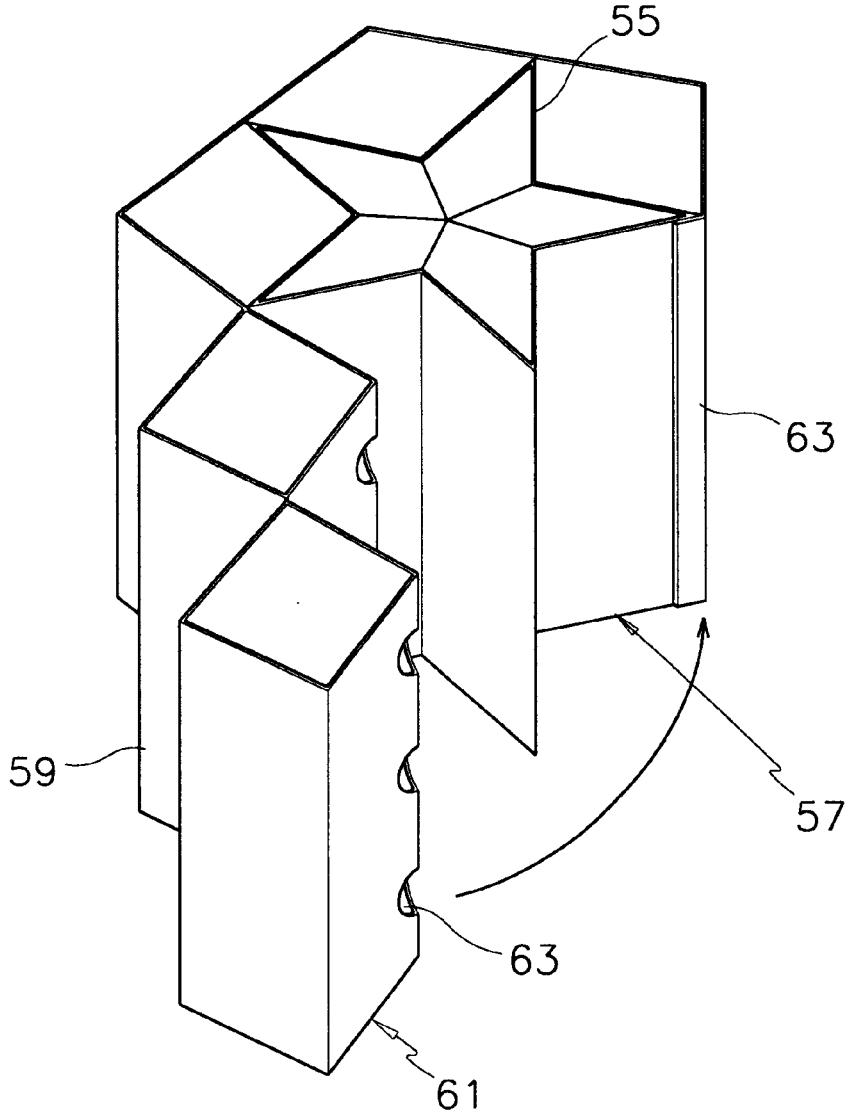
FIG. 15 is a perspective view of the multi-purpose package assembly shown in FIG. 14 illustrating a process of uniting components of the package assembly into one body.
Figure 16:
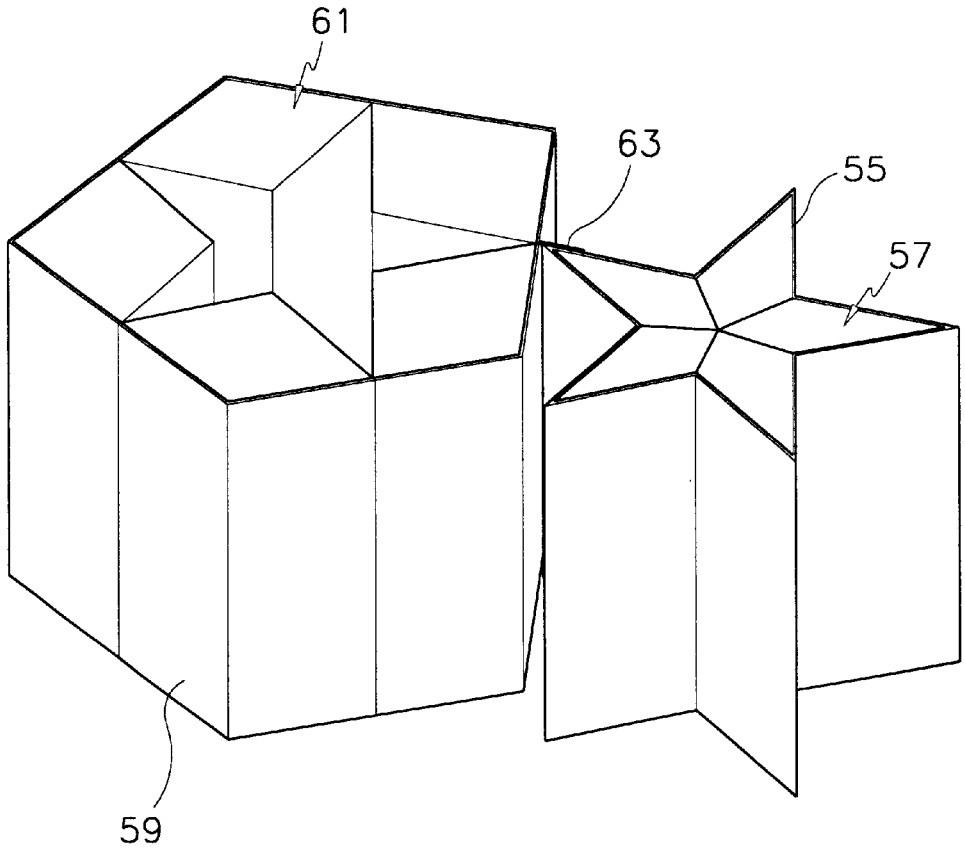
FIG. 16 is a perspective view of the multi-purpose package assembly shown in FIG. 14 illustrating a usage example.

FIGS. 14 to 16 are views of a package assembly according to a seventh preferred embodiment of the present invention. As shown in FIG. 14, the package assembly includes five base members 57 each with a relatively small size, and five containers 61 each with a relatively large size. The base members 57 are connected to each other via a connecting member 55 and the five containers 61 via another connecting member 59. An extension 63 is extended from one of the connecting members 55 and 59 to connect the base member 57 and the container 61 neighboring to each other. Each of the containers 61 is provided with a plurality of opening portions 63 for displaying the content.

The base members 57 each have neighboring two body sub-portions having a size different from that of other two neighboring body sub-portions such that when they are united into one body, the united body may be formed with a suitable star shape for being adapted to the inner shape of the surrounding containers 61.

The top and bottom sides of the containers 61 are formed each with a parallelogram shape such that they can completely surround the united body of the base members 57 in a tight manner.

In this structure, when the base members 57 are united into one body and the containers 61 externally surround the united base members 57, as shown in FIG. 15, the overall top and bottom sides of the united body are formed each with a hexagonal shape having a center-sided star-shaped portion. In contrast, when the base members 57 and the containers 61 are separately united into bodies while making the extension 63 to be a borderline between them, as shown in FIG. 16, the top and bottom sides of the united body based on the base members 57 are formed each with a star shape, whereas those of the united body based on the containers 61 are formed each with a hexagonal shape having a center-sided star-shaped hollow portion.

As described above, the inventive multi-purpose package assembly can display the content in various ways while being stored at a minimized volume.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A multi-purpose package assembly comprising:

a plurality of containers, each having an inner space for receiving a variety of things, each container being formed from a blank that is collapsible to a flattened state for storing and erectable to form the container, each container including:

a plurality of interconnected body side sub-portions, each body side sub-portion having a predetermined shape and having side edges, an upper edge and a lower edge, at least two adjacent body side sub-portions having a juncture formed by a crease in the blank along adjacent side edges of said at least two adjacent body side sub-portions, said at least two body side sub-portions being foldable and unfoldable along the crease, a first top sub-portion extending from the upper edge of one of the body side sub-portions, a second top sub-portions extending from the upper edge of another of the body side sub-portions, a first bottom sub-portion extending from the lower edge of one of the body side sub-portions, a second bottom sub-portion extending from the lower edge of another of the body side sub-portions, a top fitting member protruding from the first top sub-portion such that the first fitting member can be folded and unfolded, the top fitting member being arranged for connecting said first top sub-portion to one of the body side sub-portions or to the second top sub-portion, and a bottom fitting member protruding from the first bottom sub-portion such that the first fitting member can be folded and unfolded, the bottom fitting member being arranged for connecting said first bottom sub-portion to one of the body side sub-portions or to the second bottom sub-portion, and the package assembly further comprising a connecting members for connecting the plurality of containers in an arrangement such that the containers can be bi-directionally bent toward and away from each other.

2. The multi-purpose package assembly of claim 1 wherein the connecting member connects the plurality of containers in a serial arrangement.

3. The multi-purpose package assembly of claim 1 wherein the connecting member connects the plurality of containers in a zig-zag arrangement.

4. The multi-purpose package assembly of claim 1 wherein the connecting member is a band for binding the containers.

5. The multi-purpose package assembly of claim 4 wherein selected body side sub-portions of the containers are provided with slits for receiving the band.

6. The multi-purpose package assembly of claim 1 wherein the connecting member is formed by a plurality of extensions from selected body side sub-portions of the containers, each extension being joined to a body side sub-portion of an adjacent container by an adhesive.

7. The multi-purpose package assembly of claim 1, and further comprising a display window provided on each of the containers to display the things placed in the inner space of the container such that the things can be partially exposed to external viewers.

8. The multi-purpose package assembly of claim 7 wherein the display window receives a closure of a substantially transparent or semitransparent material.

9. The multi-purpose package assembly of claim 7 wherein the display window is formed in one or more of the body side sub-portions of the container.

10. The multi-purpose package assembly of claim 9 wherein the display window is formed with a shape of a rectangle, a heart, an oval, a polygon or a star.

11. The multi-purpose package assembly of claim 7 further comprising a base positioned on the bottom of the container to accommodate the things and more clearly display the things through the display window.

12. The multi-purpose package assembly of claim 1 wherein the containers are of polygonal or curved shape in top and bottom plan such that the containers can be bent toward each other into a cluster and when so bent the top and bottom of the cluster have a polygonal or curved shape.

13. The multi-purpose package assembly of claim 12 wherein the connecting member is a covering sheet having an lease one crease arranged to coincide with the crease formed at the juncture of the body side sub-portions of at least one container, the covering sheet being folded or unfolded along the crease thereof.

14. The multi-purpose package assembly of claim 13 wherein the body side sub-portion of one of the containers is provided with a second fitting member such that when the containers are bent into a cluster, the second fitting member retains the cluster of containers in a fixed state.

15. The multi-purpose package assembly of claim 14 wherein the second fitting member is formed at a position of the body side sub-portion such that the second fitting member is fitted into a corresponding receiving portion of the covering sheet or one of the body side sub-portions of another container.

16. The multi-purpose package assembly of claim 15 wherein the second fitting member includes a fastener selected from hook and loop, buttons and zippers.

17. The multi-purpose package assembly of claim 13 wherein the covering sheet is provided with a second fitting member such that when the containers are bent into a cluster, the second fitting member retains the cluster of containers in a fixed state.

18. The multi-purpose package assembly of claim 17 wherein the second fitting member is formed at a position on the covering sheet such that the second fitting member is fitted into a corresponding receiving portion of the covering sheet or a body side sub-portion of one of the containers.

19. The multi-purpose package assembly of claim 13 wherein a hand-gripping member protrudes from a body side sub-portion of one of the containers or from the covering sheet such that when the containers are bent to form a cluster, a user can carry the cluster by use of the hand-gripping member.

20. The multi-purpose package assembly of claim 19 wherein the hand-gripping member includes an extension from the body side sub-portion of the container or the covering sheet, and an opening formed at a center area of the extension.

21. A multi-purpose package assembly comprising:

a plurality of base members, each having a predetermined shape and being of a relatively smaller size;

a first connecting member for connecting the base members to each other such that the base members can be bi-directionally bent toward and away from each other;

a plurality of containers each having a predetermined shaped and a relatively larger size;

a second connecting member for connecting the containers to each other such that the containers can be bi-directionally bent toward and away from each other; and a third connecting member for connecting one of the base members to one of the containers in adjacent relation;

wherein when the base members are bent toward each other, they form a cluster having a top and a bottom, each with a predetermined shape;

wherein when the containers are bent toward each other into a cluster, the cluster has a top and a bottom, each with a predetermined shape; and wherein when the base members and the containers are sequentially and respectively bent toward each other into clusters with the base members inwardly of the containers, the clusters form a united body having a top and a bottom, each with a predetermined shape.

22. The multi-purpose package assembly of claim 21 wherein each of the base members has a first pair of adjacent body side sub-portions and a second pair of adjacent body side sub-portions, the sizes of the body side sub-portions of the first pair being different from the sizes of the body side sub-portions of the second pair such that the top and bottom of the cluster of base members have shapes complementary to the inner peripheries of the top and bottom of the cluster of container.

23. The multi-purpose package assembly of claim 21 wherein the top and bottom of each of the containers are of a polygonal shape such that the cluster of base members is completely surrounded by the cluster of containers.

* * * * *